US007219902B1

(12) United States Patent
Herold

(10) Patent No.: US 7,219,902 B1
(45) Date of Patent: May 22, 2007

(54) FLEXIBLE TRAVEL BAG WITH INTEGRATED SUPPORT TO PROTECT BAG FROM WEAR

(75) Inventor: Jeffrey C. Herold, Huntington Beach, CA (US)

(73) Assignee: West Coast Trends, Inc., Huntington Beach, CA (US)

( * ) Notice: Subject to any disclaimer, the term of this patent is extended or adjusted under 35 U.S.C. 154(b) by 0 days.

(21) Appl. No.: 10/678,987

(22) Filed: Oct. 2, 2003

Related U.S. Application Data

(63) Continuation of application No. 08/734,254, filed on Oct. 21, 1996, now abandoned.

(51) Int. Cl.
*B62B 1/00* (2006.01)

(52) U.S. Cl. ..... 280/47.26; 280/47.24; 280/639; 280/37

(58) Field of Classification Search ..... 280/47.24, 280/47.27, 47.28, 37, 47.17, 47.19, 47.371, 280/47.315, 30, 47.26, 43.1, DIG. 6; 190/18 A, 190/15; 206/315.4
See application file for complete search history.

(56) References Cited

U.S. PATENT DOCUMENTS

| | | | | |
|---|---|---|---|---|
| 101,041 | A | 3/1870 | Nisbet | |
| 1,031,033 | A * | 7/1912 | Williams | 383/121 |
| 1,325,692 | A | 12/1919 | Cross | |
| 1,555,772 | A | 9/1925 | Stripe | |
| 1,859,970 | A | 5/1932 | Kaufmann | |
| 2,466,160 | A | 4/1949 | Deorrlamm | |
| 2,602,676 | A | 7/1952 | Fieldhouse | |
| 2,718,251 | A | 9/1955 | Barbato | |
| 2,868,559 | A | 1/1959 | Vincelette | |
| 2,879,073 | A * | 3/1959 | Van Voorhees | 280/42 |
| 3,125,854 | A | 3/1964 | Skowron, Sr. | |
| 3,128,854 | A | 4/1964 | Specht | |
| 3,158,299 | A | 11/1964 | Wier et al. | |
| 3,316,951 | A | 5/1967 | Jacobson | |
| 3,418,005 | A | 12/1968 | Allina | |
| 3,471,163 | A | 10/1969 | Swara | |
| 3,693,849 | A | 9/1972 | Knabenbauer | |
| 3,985,171 | A | 10/1976 | Summers et al. | |
| 3,998,304 | A | 12/1976 | Edgerton, Jr. et al. | |
| 4,059,464 | A | 11/1977 | Geller et al. | |
| 4,301,849 | A | 11/1981 | Litwack et al. | |
| 4,420,024 | A * | 12/1983 | Clayton | 206/315.4 |
| D280,362 | S | 9/1985 | Allen | |
| 4,596,397 | A | 6/1986 | Conti | |

(Continued)

FOREIGN PATENT DOCUMENTS

| | | |
|---|---|---|
| DE | 3400956 | 7/1985 |
| FR | 2590458 | 5/1987 |
| JP | 621 78 26 | 8/1994 |

*Primary Examiner*—Hau Phan

(57) ABSTRACT

A travel bag fabricated of flexible material such as nylon and is combined with a specialized rigid support to form combination. The support is configured to protect portions of the bag which are subject to high wear and tear during normal use. In addition, the support is formed to receive and hold wheels therein which facilitate transportation of the bag. The support is constructed of a high impact rigid material such as plastic to resist wear due to friction and impact which may accompany a bag in use. The support is specially arranged to cooperate with the flexible portion of the bag. The shape of the support tends to defend the corners of the bag against particular wear. The flexible main portion and the support portions are affixed together.

35 Claims, 4 Drawing Sheets

U.S. PATENT DOCUMENTS 4,657,135 A 4/1987 Kjose
4,729,460 A 3/1988 Kim
4,752,004 A 6/1988 Very
D296,955 S 8/1988 Janney et al.
4,792,152 A 12/1988 Carolan
4,905,827 A 3/1990 Kim
4,911,465 A 3/1990 Hauer
4,934,573 A 6/1990 Jaeger
4,953,768 A 9/1990 Muse
5,002,401 A * 3/1991 Blackman ..... 190/127
5,033,759 A 7/1991 Wix
5,071,147 A 12/1991 Stansbury
5,105,919 A 4/1992 Bomes et al.
5,109,961 A 5/1992 Bergman
5,112,068 A 5/1992 Liao et al.
5,215,318 A 6/1993 Capraro
5,244,219 A 9/1993 Hadlum
5,265,894 A 11/1993 Dunn
5,277,449 A * 1/1994 Schmidt ..... 280/655
5,289,906 A 3/1994 Guidi
5,295,565 A 3/1994 Latshaw
5,307,908 A 5/1994 Shyr et al.
5,374,073 A 12/1994 Hung-Hsin
5,383,505 A 1/1995 Cordasco, Jr.
5,431,262 A 7/1995 Rekuc et al.
5,443,156 A 8/1995 Shioda
5,447,261 A 9/1995 Mitomi et al.
5,456,342 A 10/1995 Rekuc et al.
5,470,095 A 11/1995 Bridges
5,498,010 A 3/1996 Stube
5,515,897 A 5/1996 Fehan
5,524,737 A 6/1996 Wang
5,575,362 A 11/1996 Franklin et al.
5,632,496 A 5/1997 Nelson
5,634,576 A 6/1997 Arbel
5,743,363 A 4/1998 Rekuc et al.
5,743,447 A 4/1998 McDerrmott
5,749,503 A 5/1998 Wulf et al.
6,068,271 A 5/2000 Lustica
6,595,358 B1 * 7/2003 Speck ..... 190/110

* cited by examiner

FLEXIBLE TRAVEL BAG WITH INTEGRATED SUPPORT TO PROTECT BAG FROM WEAR

CROSS-REFERENCE TO RELATED APPLICATION

This application is a continuation and claims priority based on parent application Ser. No. 08/734,254, entitled "FLEXIBLE TRAVEL BAG WITH SUPPORT INTEGRATED TO PROTECT BAG FROM WEAR" by Jeffrey C. Herold, filed on Oct. 21, 1996 now abandoned.

BACKGROUND OF THE INVENTION

1. Field

This invention is generally concerned with luggage materials, configurations and designs, and is specifically concerned with travel bags having specialized support integrated therewith to provide a strong base which is resistant to wear and damage occasioned by use of said bag.

2. Prior Art

The frequent traveler is well aware of need for high quality travel bags. Transit systems tend to be quite taxing on baggage of low quality. Bags get stuck or snagged on equipment such as doors, escalators, conveyors, carts, handrails, armrests, among others. As travel bags tend to be heavy when loaded, they may be equipped with wheels to facilitate transport across smooth floors. Wheels are typically mounted into the bottom of such bags. An additional feature may include a handle. Handles are sometimes retractable into the bag such that the bag occupies a smaller space and allows for convenient storage.

Some bags are designed for very heavy loads. Commonly known as "duffel" bags, a flexible material forms an enclosure into which objects may be packed. For example, a bag designed to carry sporting equipment may be made of strong canvas and reinforced at the seams with webbing or alternative durable materials. These bags may be particularly suited for carrying large and bulky objects which cause increased wear on the bags.

An example of a travel bag suited for sporting equipment is taught by Mr. Kjose in U.S. Pat. No. 4,657,135. The bag is designed to carry a second containment vessel of similar shape. It is shown with wheels 70 attached about its bottom at various locations. Additionally, it has a zip opening 21 and a handle 80. With the wheels distributed as shown, i.e. with a long wheelbase, the bag tends to be difficult to steer. In addition, the lower corners of the bag tend to be exposed. They may be engaged by or come into contact with many objects which may cause wear to them.

An enclosure for sporting equipment is described in detail in U.S. Pat. No. 4,953,768 by inventor Muse. The enclosure is particularly designed to protect its contents against the elements and specifically rain. The cover may similarly be equipped with a handle which cooperates with the cover to which it is attached.

Mr. Hauer of Washington teaches a wheeled bag in the form of a cart with a handle and accessory holder in U.S. Pat. No. 4,411,465. The two wheels are spread such that they are broader than the bag is in order to resist tipping in a lateral direction.

Finally, Mr. Dunn of Santa Ana, Calif. teaches a novel bag in which a golf club set is to be carried. U.S. Pat. No. 5,265,894 shows a bag which includes wheels 32 and a handle 25. Of particular interest is the bottom member which is a rigid element. The sides of the bag are fastened to the bottom member which supports the wheels.

Perhaps the most sophisticated experts with regard to travel bags include airline personnel. Airline travelers will certainly recall that flight attendants and pilots often tote a wheeled bag through airport and hotel lobbies. The bag is typically made of durable canvas or similar cloth material. With a retractable handle, the bag is pulled behind the user while the bottom is supported on two wheels in contact with the floor. The wheels are preferably quite small and are sometimes built into the bag at wheel wells which are riveted to the canvas bottom. These bags are conveniently designed to fit the compartments of airplanes. They are durable in design, but tend to support a load of only a few tens of pounds. As such, the material used to form the bags is generally only mildly resistant to high friction loads. The corners of these bags are generally made of soft materials which tends to get caught on various objects including sharp metallic objects such as those of which a conveyor might be comprised. The metallic objects tend to tear and destroy the bags. Additionally, the wheels are sometimes subject to very high impact force and may easily break away from the canvas bag to which they are attached. These travel bags may be dragged up or down stairs. Designers have included ribs made of plastic which run in a longitudinal direction down the back of the bag. These ribs may help allow the bag to be dragged over a bumpy surface such as stairs. However, the ribs are usually attached to the soft material of the bag by rivets or adhesives. Objects may operate to tear the ribs from the bag when they engage the ends of the ribs.

Most travel luggage can be classified either "soft" luggage or "hard" luggage. Soft luggage is lightweight and more easily made compact for storage; while hard luggage tends to be more bulky. However, hard luggage is quite strong and may stand up to extreme conditions which act to wear or damage the luggage. Soft luggage is more easily destroyed by conditions to which it may be exposed in normal use. It would be desirable to provide luggage which benefits from the advantages offered by each of these types of luggage, without having the problems associated with either.

Notwithstanding, new configurations have been discovered which provide novel designs and forms far travel bags, particularly travel bags subject to high wear and damage due to the heavy loads which they support. In contrast to the good and useful inventions mentioned, each having certain features that are no less than remarkable, the instant invention is concerned with providing a long lasting, wear resistant travel bag far heavy loads.

SUMMARY OF THE INVENTION

Comes now, Jeffrey C. Herald with an invention of a travel bag including combinations of materials and configurations arranged to provide a superior travel bag which is resistant to damage due to impact and friction forces incident thereon, yet is lightweight and easily made compact for storage.

A travel bag of the invention may be comprised of two primary elements. A first element is a strong, flexible material which forms an enclosure and the second element is a rigid material which forms a protective barrier and support. The elements are formed in shapes to cooperate together as mates. The two elements are affixed together in a fashion to realize a high utility travel bag having superior properties. The bag may be compactly stored as soft luggage, but is durable against damage as is hard luggage. The combination provides a specialized bag which is particularly useful for transporting large and heavy loads such as those associated with sporting equipment.

OBJECTIVES OF THE INVENTION

Accordingly, it is a primary object of the invention to provide a heavy duty travel bag.

It is an additional object to provide a travel bag which resists wear commonly occasioned by such bags.

It is an object to provide a travel bag which is easily made compact far storage.

It is an object to provide a bag with a strong base which supports integration of wheels thereon.

It is an object to provide a travel bag with extra support at regions subject to high friction, snag, tear and impact and other contact forces.

These objectives and others will be readily appreciated in view of the following examples of preferred embodiments. A better understanding can be had with reference to the detailed description of preferred embodiments and with reference to the appended drawings. These embodiments represent particular ways to realize the invention and are not inclusive of all ways possible. Therefore, there may exist many embodiments that do not deviate from the spirit and scope of this disclosure as set forth by the claims, but do not appear here as specific examples. It will be appreciated that a great plurality of alternate versions are possible.

BRIEF DESCRIPTION OF THE DRAWING FIGURES

These and other features, aspects, and advantages of the present invention will become better understood with regard to the following description, appended claims and drawings where:

PREFERRED EMBODIMENTS OF THE INVENTION

Figure 1:
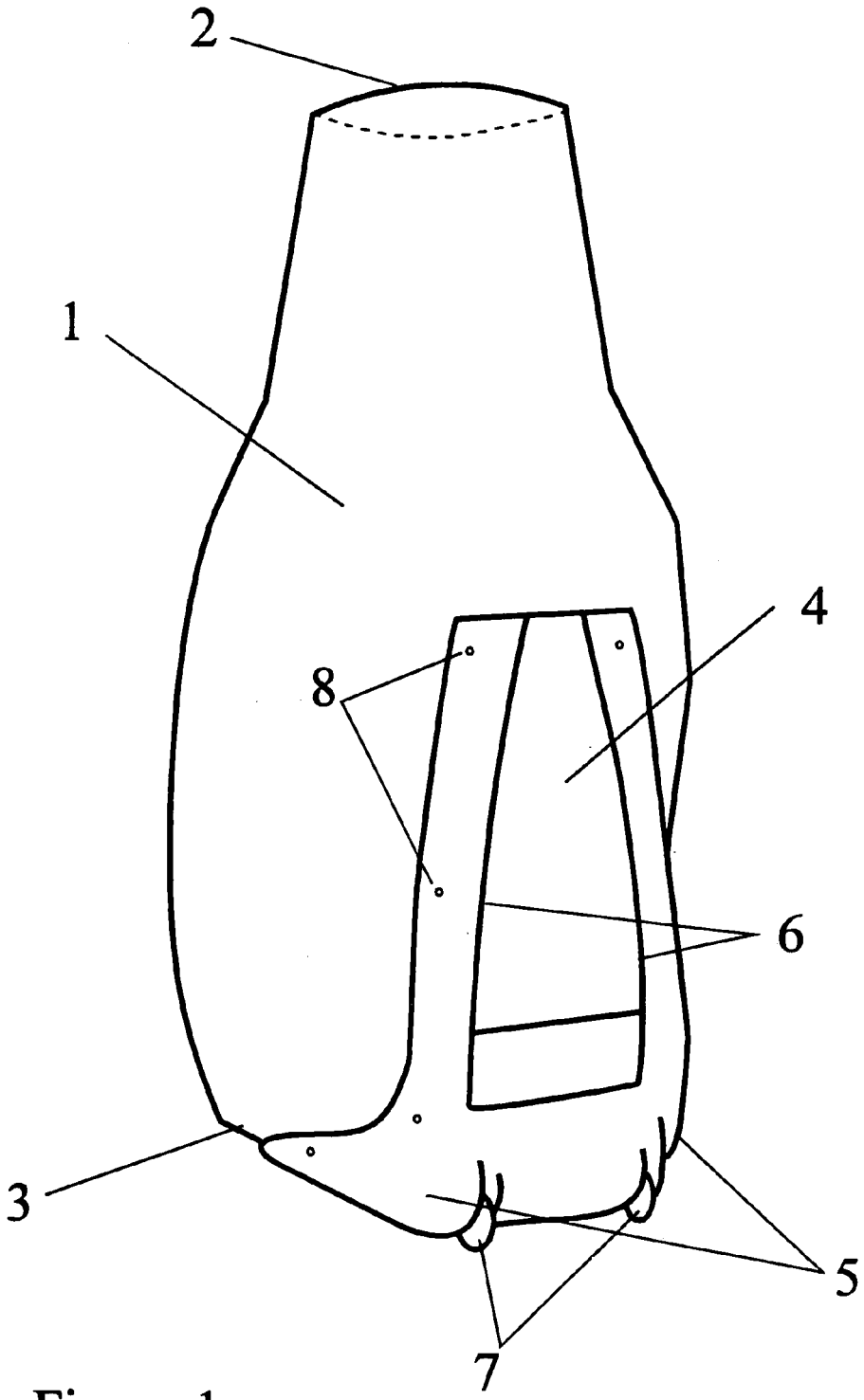
FIG. 1 shows a travel bag of the invention in a perspective rear view.

In accordance with each of the preferred embodiments of the invention, there is provided a travel bag including a flexible enclosure element integrated with a rigid support to protect the bag from wear. It will be appreciated that each of the embodiments described is an apparatus and that the apparatus of one preferred embodiment may be different than the apparatus of another embodiment.

A travel bag of the invention is comprised of two primary elements. A first element is a flexible material which forms an enclosure and the second element is a rigid device which forms a protective barrier and support.

An enclosure is formed by proper arrangement of a durable, flexible material such as nylon, canvas, denim, polyesters or other suitable materials. Portions of material may be cut from cloth in patterns which can be sewn together. Seams and other regions subject to high stress may be reinforced and improved by supportive webbing materials. Strong rivets may be used to attach and affix webbing to the flexible material. In addition, webbing may be sewn to the flexible material. The enclosure typically has an opening which may be alternatively opened and closed with a zipper or other fastener. When the enclosure is loaded, it may take a certain shape due to the form and limits of the materials used to make the enclosure. A handle may be provided at an end or along a portion of a side of the bag. A handle so placed, suggests a "top" and "bottom" of a bag. The enclosure portion of a bag may therefore have: a bottom portion, a top portion, and side portions each made of flexible material. The bottom of the enclosure meets the sides to form a seam. Two sides and the bottom may be joined together and form a corner. A lower quadrant of the flexible enclosure might include two corners, a portion of the enclosure bottom, and portions of the enclosure sides. Normal handling of the bag may cause the lower portion of the bag to be exposed to various forms of wear and contact forces such as impact forces and friction forces. Accordingly, the bottom quadrant of the bag is the focus of a specialized support element.

A rigid member shaped to cooperate in form with the enclosure described above, and additionally shaped and designed to resist specific forces to which the element may be exposed, is provided. It may include wheel wells, protective corners, and reinforcement ribs all integrated as a together single piece. This rigid member may be formed of rugged material such as plastic or metal which are highly durable and resist wear and damage due to contact forces. High impact plastics may be particularly suitable. The rigid member takes a specialized shape. It has a convex side and a concave side. The concave side is shaped to receive therein, a quadrant or substantial portion thereof, the flexible enclosure; particularly a bottom quadrant thereof. A rigid member so designed can be fastened and affixed to a flexible enclosure described above. They may be fastened in a plurality of ways, however, a simple and effective way which is preferred is via rivets. Snaps, Velcro, adhesives or other fasteners may also work for same alternative versions. The convex side may support secondary elements which include: wheel wells, reinforcement ribs, ruggedized corners.

Figure 2:
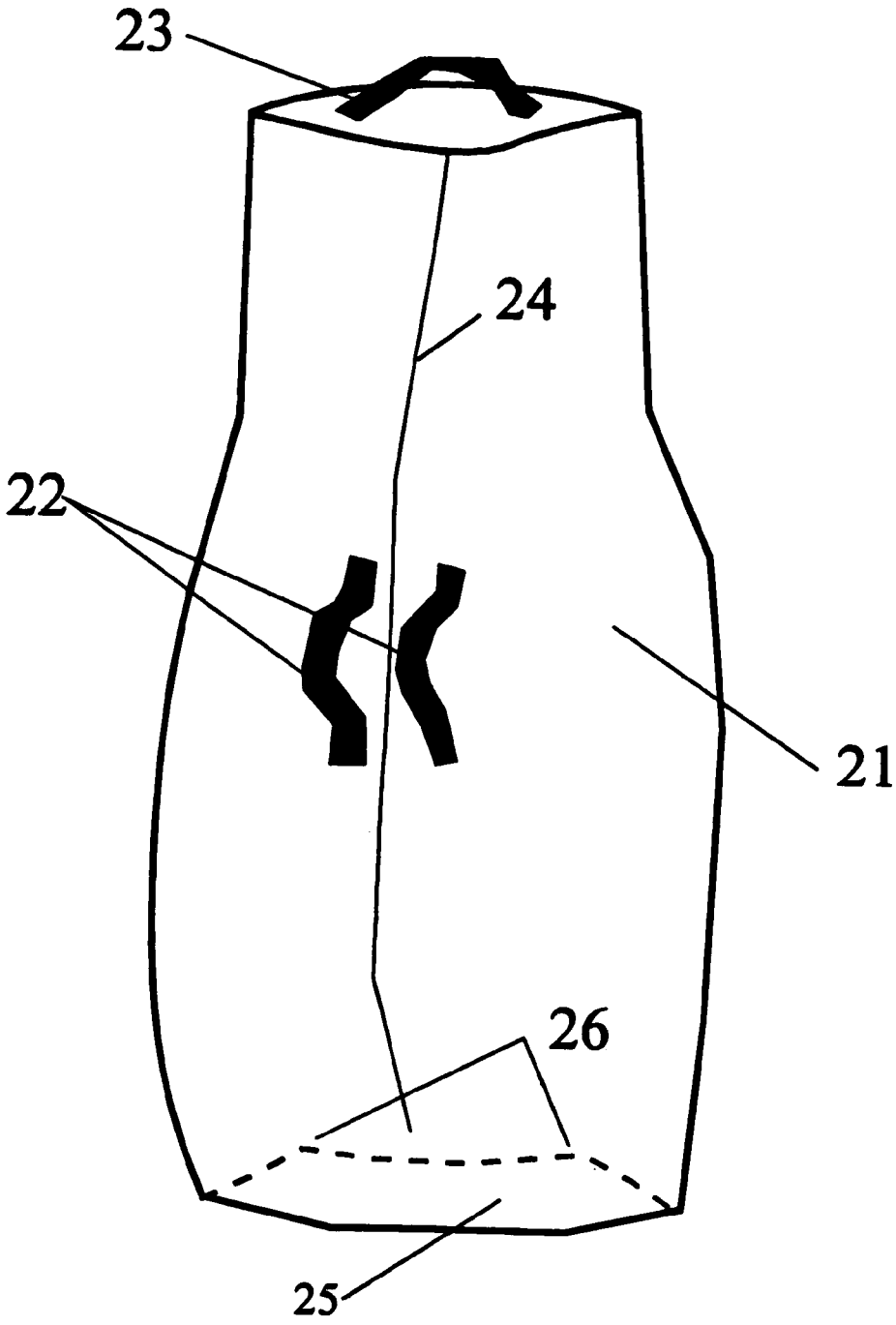
FIG. 2 shows a travel bag of the invention from a front view.

With reference to the drawing figures, a preferred embodiment is shown which represents the best make contemplated. An enclosure 1 is formed by sewing together various pieces or panels of material. The enclosure generally has a top portion 2, and a bottom portion 3. The sides of the bag generally form a cylindrical shape with axial symmetry. A rigid support member 4 is formed of hard material in a shape substantially similar to a quadrant of the enclosure form. In particular, the rigid support member may have two corners 5. Reinforcing ribs 6 may be integrated into the single piece element to add strength thereto. The support member is preferably formed to accommodate wheels 7 near its bottom. A front view of a travel bag of the invention is shown in FIG. 2. The bag 21 may be provided with handles 22 on either side of a zipper opening 24. Alternatively, or in addition, a handle 23 may be attached to the top of the bag. The bottom of the bag 25 may be of arbitrary shape but generally contains two corners 26. These corners are matingly received into corners 5 of the rigid support member shown in FIG. 1.

Figure 3:
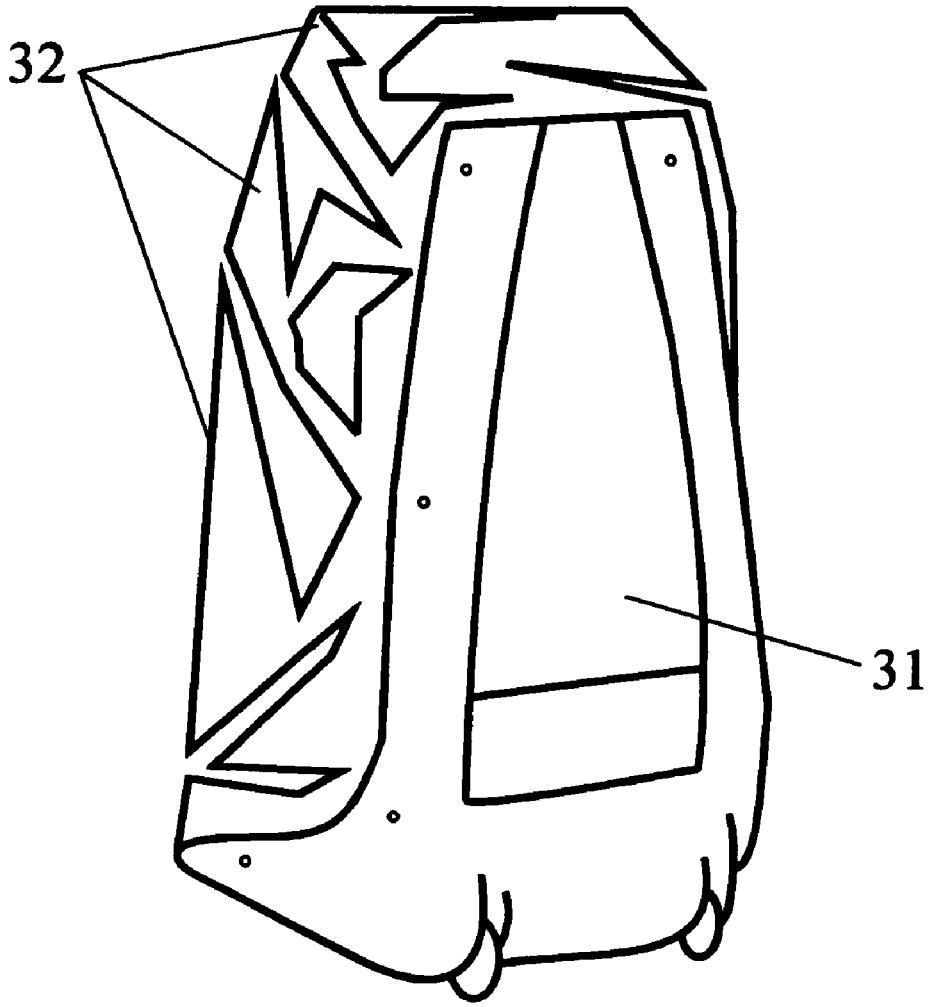
FIG. 3 shows a travel bag of the invention in a storage position.

A drawing in FIG. 3 shows the same rigid support member 31, however, the flexible enclosure portion 32 of the bag has been pushed down into the space of the concave part of the rigid support member. In this way, a bag can be made quite compact for storage. The entire bag occupies a space less than the one quarter of its capacity. It is an important feature that a travel bag be provided which can realize benefits of soft luggage and hard luggage. The rigid member tends to be very durable and protect the soft enclosure like hard luggage, while the soft enclosure portion tends to be lightweight and pack away in a fashion comparable to soft luggage.

Figure 4:
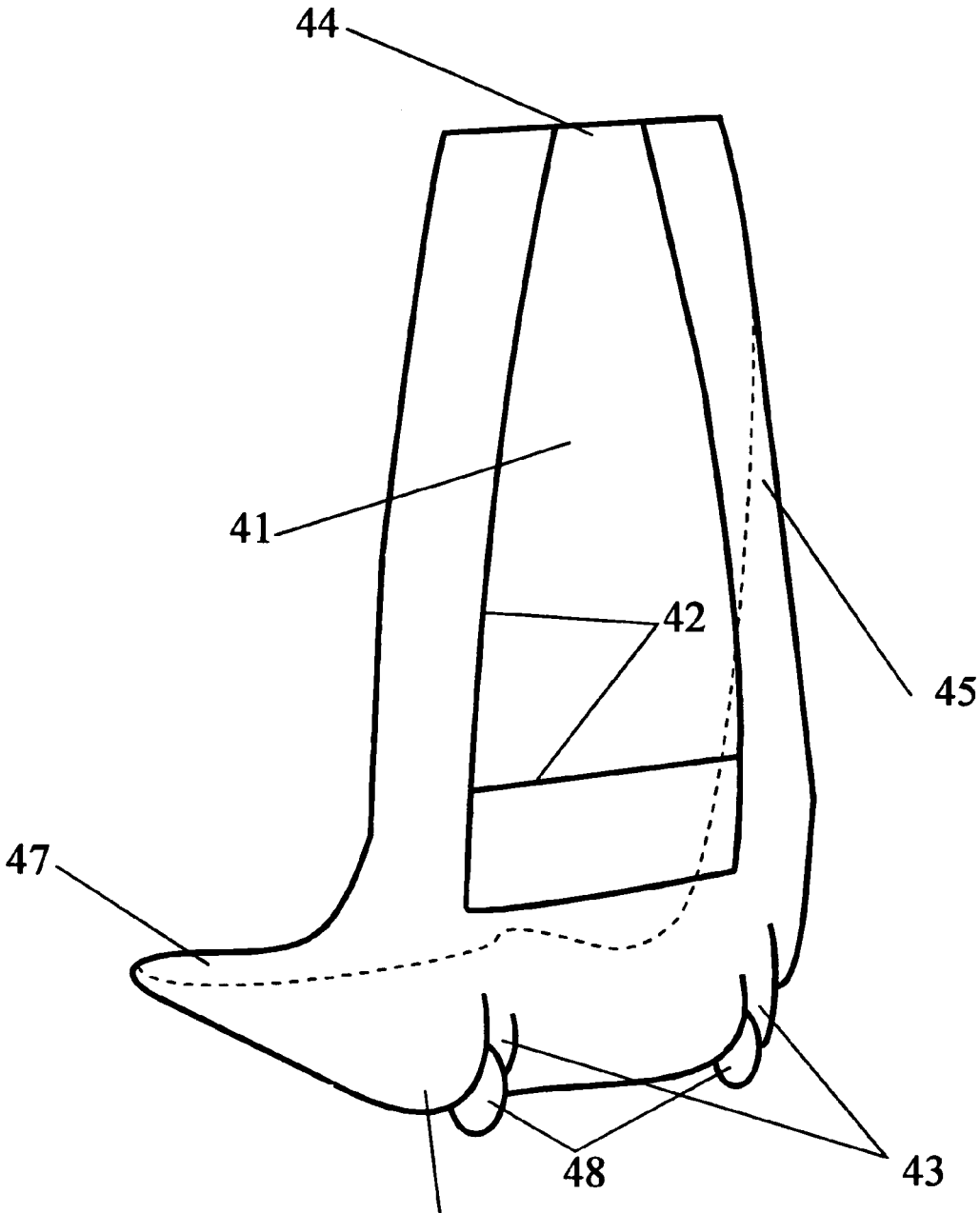
FIG. 4 shows details of an element of a travel bag which is a rigid member.

FIG. 4 shows a rigid member 41 may be formed of a single piece of material which has been molded or formed into a best shape. The rigid support member generally has a main portion which may extend from the bottom of the enclosure, along a portion of the side, and terminates near the middle of the enclosure. This main portion may have a thickness which is preferably a fraction of an inch. It is generally flat however it may be curved at its sides 45 to form a slightly concave side and a convex side. The rigid member additionally has a bottom portion which meets the main portion to form a smooth and rounded or curved joint. The bottom extends away from the main portion at approximately a right angle. The bottom portion may similarly be formed in a slightly curved piece where the concavity is oriented upwardly. The rigid member also has side portions 47. The side portions meet the bottom and main portions to form a corner(s) 46. The portions together form a cavity into which a soft flexible enclosure will be well received. The shape may include reinforcement elements 42 such as ribs which run along longitudinal and lateral directions of the device. These ribs may be ridges of material which extend slightly above the surface. They provide additional strength against bending and flexing. They are particularly important when a bag is dragged over rough surfaces such as the edges of stairs or escalators. Additionally, wells 43 formed to receive wheels 48 therein and to support mounting hardware for the wheels may be provided.

It is important to draw attention to the corner 46. When a wheeled travel bag is pulled by a handle, the corners of the bag are subject to great probability of being damaged. They tend to come into contact with many obstacles and objects which may damage a soft bag. Previously, soft bags were reinforced against such contact by merely adding an extra layer of material at the corners or by putting small corner guards perhaps made of a special rugged material. These types of protection help to alleviate the problem and extend the life of the bag, however, as the corner protectors stand alone and are not integrated with a rigid support system they often fail and eventually become separated from the bag to which they are sewn. The rigid support member described has great resistance against damage caused by contact forces incident at the corners 46. When the rigid member is made of high impact plastic; the corners may stand up to a vigorous beating while protecting the bottom quadrant and sides of the bottom quadrant of the bag from damage. The corners cannot be separated from the bag as they are integrated with the entire rigid member as a single piece of formed material. Great advantage is realized by forming the rigid member of a single piece. Reinforcement ribs, wheel wells, and corner protectors are integrated together in a single device. In this way, the individual elements cannot be separated from each other or from the bag to which they are attached as is common in bags of the art. In addition, a cost advantage is realized because these elements do not have to be independently formed and attached to the bag. A single step of forming a rigid member in the manner described provides a travel bag with strong protection at the wheel wells, corners and ribs. This is particularly important in view of the nature in which some travel bags are used. Travel bags for heavy loads are particularly advantaged by this arrangement. The travel bag described has some advantages associated with soft and hard luggage without the problems which otherwise accompanies those types of devices.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

What is claimed is:

1. A travel bag for enclosing, protecting and transporting contents placed therein and for collapsing to a storage position when contents are not placed therein, said travel bag comprising:

a flexible enclosure; and an external rigid support member, said external rigid support member having a main portion, a bottom portion, and side portions, the bottom portion joining the main and side portions to form a partially enclosed concave part into which a portion of said flexible enclosure is fitted and affixed, said external rigid support member fitting only over substantially a quadrant of said flexible enclosure so that the remaining substantially three quadrants of said flexible enclosure are not enclosed by a support member;

said flexible enclosure being formed of a strong material arranged as an enclosure having a top, sides and bottom portions, said sides being flexible so that when said bag does not contain contents said top can be collapsed into said concave part in a storage position;

said flexible enclosure including an opening formed in said enclosure and closure means connected to said enclosure so that said closure means can be engaged to close said opening.

2. A travel bag according to claim 1 wherein when said flexible enclosure is in the storage position said flexible enclosure occupies the concave part of said external rigid support member.

3. A travel bag according to claim 1 wherein said external rigid support member extends from the bottom portion of said enclosure along a portion of the back of said enclosure and along a portion of the sides of said enclosure.

4. A travel bag according to claim 1 wherein the main portion of said external rigid support member extends from the bottom portion of said enclosure, along a portion of the back of said enclosure and terminates near the middle of said enclosure.

5. A travel bag according to claim 1 wherein the main portion of said external rigid support member is located on the back portion of said enclosure and extends between the bottom portion of said enclosure and the middle of said enclosure.

6. A travel bag of claim 1 wherein said flexible enclosure includes a top, sides and a bottom portion, and said opening extends along one of said sides.

7. A travel bag of claim 6 wherein said opening extends the complete length of one of said sides.

8. A travel bag of claim 1 wherein said closure means is a zipper.

9. A travel bag of claim 1 wherein the main portion of the rigid enclosure is substantially flat.

10. A travel bag for enclosing, protecting and transporting contents placed therein comprising:

a flexible enclosure; and an external rigid support member, said flexible enclosure being formed of a strong material arranged as an enclosure having a top, sides and bottom portions, said flexible enclosure including an opening formed in said enclosure and closure means connected to said enclosure so that said closure means can be engaged to close said opening;

said external rigid support member having a main portion, a bottom portion, and side portions, the bottom portion joining the main and side portions to form a partially enclosed cavity into which a portion of said flexible enclosure is fitted and affixed, the main portion extending from the bottom of said enclosure along a portion of the side and terminating near the middle of said enclosure, wherein said top can be collapsed into said partially enclosed cavity;

said external rigid support member fitting only over substantially a quadrant of said flexible enclosure so that the remaining substantially three quadrants of said flexible enclosure are not enclosed by a support member.

11. A travel bag according to claim 10 wherein said rigid support member is formed in a shape substantially similar to a quadrant of said flexible enclosure.

12. A travel bag of claim 10 wherein said opening extends along one of said sides.

13. A travel bag of claim 12 wherein said opening extends the complete length of one of said sides.

14. A travel bag of claim 10 wherein said closure means is a zipper.

15. A travel bag for enclosing, protecting and transporting contents placed therein comprised of two primary members:

a flexible enclosure; and an external rigid support member, said flexible enclosure being formed of a strong material arranged as an enclosure having a top, sides and bottom portions, said flexible enclosure including an opening formed in said enclosure and closure means connected to said enclosure so that said closure means can be engaged to close said opening;

said external rigid support member being formed of a single piece rugged material having a main portion, a bottom portion, and side portions, the bottom portion joining the main and side portions to form a partially enclosed cavity into which a portion of said flexible enclosure is fitted and affixed, wherein said top can be collapsed into said partially enclosed cavity;

said external rigid support member fitting only over substantially a quadrant of said flexible enclosure so that the remaining substantially three quadrants of said flexible enclosure are not enclosed by a support member.

16. A travel bag of claim 15, said flexible enclosure being formed of a material from the group:

canvas, denim, cotton, nylon, acrylics and polyesters; and said rigid base being formed of a plastic material.

17. A travel bag of claim 15 said flexible enclosure being formed of a material from the group:

canvas, denim, cotton, nylon, acrylics and polyesters; and said rigid base being formed of a metallic material.

18. A travel bag of claim 15 said external rigid support member further comprising: wheel wells, said wheel wells being arranged on a curved joint between the main portion and the bottom portion operable to receive therein wheels and wheel mounting hardware.

19. A travel bag of claim 15 said external rigid support member further comprising reinforcement ribs, the reinforcement ribs being formed on said rigid member main portion in longitudinal or lateral directions.

20. A travel bag of claim 15 said flexible enclosure having two corners and said external rigid support member having two corners, the corners of the flexible enclosure being matingly received and affixed into the corners of the external rigid support member.

21. A travel bag of claim 20 said flexible enclosure being affixed to said external rigid support member by rivets.

22. A travel bag of claim 21 said external rigid support member having a convex side and a concave side, said flexible enclosure being affixed to the concave side of said external rigid support member, said wheel wells being affixed to the convex side of the external rigid support member at the curved joint.

23. A travel bag of claim 15 wherein said opening extends along one of said sides.

24. A travel bag of claim 23 wherein said opening extends the complete length of one of said sides.

25. A travel bag of claim 15 wherein said closure means is a zipper.

26. A travel bag for enclosing, protecting and transporting contents placed therein, said bag comprising two primary members as follows:

a flexible enclosure; and an external rigid support member, said flexible enclosure being formed of a strong material of a top, sides and bottom portions, said external rigid support member being formed of a single piece rugged material having a main portion, a bottom portion, and side portions, the bottom portion joining the main and side portions to form a partially enclosed cavity into which a portion of said flexible enclosure is fitted and affixed, wherein said top can be collapsed into said partially enclosed cavity;

said external rigid support member fitting only over substantially a quadrant of said flexible enclosure so that the remaining substantially three quadrants of said flexible enclosure are not enclosed by a support member.

27. A travel bag of claim 26, said external rigid member having a single closed loop periphery.

28. A travel bag of claim 26, said flexible enclosure sides being formed of a single piece which is wrapped in a cylindrical body to form a substantially elongated element which may be joined by said top and bottom portions.

29. A travel bag of claim 26, said external rigid member extending from a bottom edge to terminate near the middle of the flexible enclosure member.

30. A travel bag of claim 26, said external rigid member having a concave side to cooperate in form with the flexible enclosure member.

31. A travel bag of claim 26, said external rigid member further having corners integrated with the entire external rigid member as a single piece of formed material whereby the corners cannot be separated from the flexible enclosure.

32. A travel bag of claim 26, said flexible enclosure member is affixed to the external rigid member such that it may be pushed through the closed loop periphery and into the partially enclosed cavity formed by the external rigid member.

33. A travel bag of claim 26 wherein said opening extends along one of said sides.

34. A travel bag of claim 33 wherein said opening extends the complete length of one of said sides.

35. A travel bag of claim 26 wherein said closure means is a zipper.

* * * * *

US007219902C1

(12) EX PARTE REEXAMINATION CERTIFICATE (10194th)

United States Patent

Herold

(10) Number: US 7,219,902 C1

(45) Certificate Issued: Jun. 19, 2014

(54) FLEXIBLE TRAVEL BAG WITH INTEGRATED SUPPORT TO PROTECT BAG FROM WEAR

(75) Inventor: Jeffrey C. Herold, Huntington Beach, CA (US)

(73) Assignee: West Coast Trends, Inc., Huntington Beach, CA (US)

Reexamination Request:
No. 90/011,850, Aug. 8, 2011

Reexamination Certificate for:

| | |
|---|---|
| Patent No.: | **7,219,902** |
| Issued: | **May 22, 2007** |
| Appl. No.: | **10/678,987** |
| Filed: | **Oct. 2, 2003** |

Related U.S. Application Data

(63) Continuation of application No. 08/734,254, filed on Oct. 21, 1996, now abandoned.

(51) Int. Cl.
*B62B 1/00* (2006.01)

(52) U.S. Cl.
USPC ..... 280/47.26; 280/37; 280/47.24; 280/639

(58) Field of Classification Search
None
See application file for complete search history.

(56) References Cited

To view the complete listing of prior art documents cited during the proceeding for Reexamination Control Number 90/011,850, please refer to the USPTO's public Patent Application Information Retrieval (PAIR) system under the Display References tab.

*Primary Examiner* — Sara Clarke

(57) ABSTRACT

A travel bag fabricated of flexible material such as nylon and is combined with a specialized rigid support to form combination. The support is configured to protect portions of the bag which are subject to high wear and tear during normal use. In addition, the support is formed to receive and hold wheels therein which facilitate transportation of the bag. The support is constructed of a high impact rigid material such as plastic to resist wear due to friction and impact which may accompany a bag in use. The support is specially arranged to cooperate with the flexible portion of the bag. The shape of the support tends to defend the corners of the bag against particular wear. The flexible main portion and the support portions are affixed together.

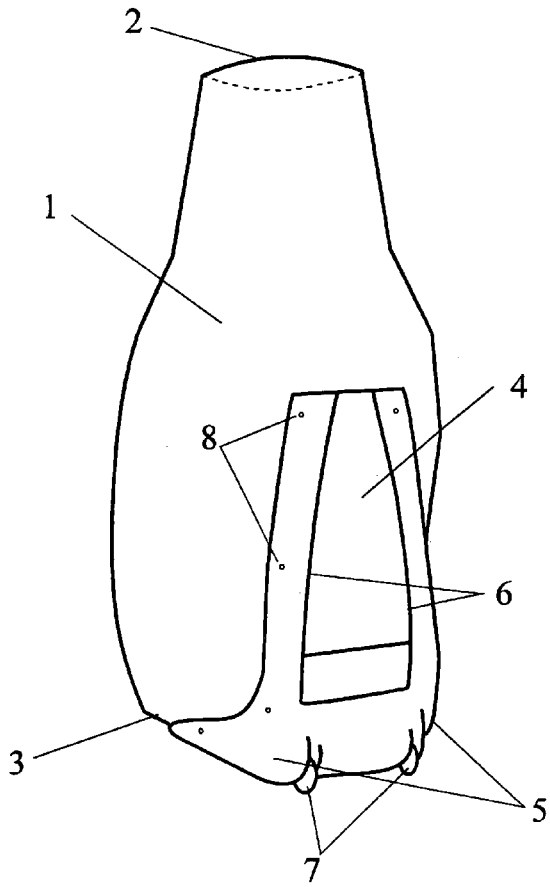

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6, 12, 23 and 33 are cancelled.

Claims 1, 7, 10, 13, 15, 24, 26 and 34 are determined to be patentable as amended.

Claims 2-5, 8, 9, 11, 14, 16-22, 25, 27-32 and 35, dependent on an amended claim, are determined to be patentable.

1. A travel bag for enclosing, protecting and transporting contents placed therein and for collapsing to a storage position when contents are not placed therein, said travel bag comprising:

a flexible enclosure; and an external rigid support member, said external rigid support member having a main portion, a bottom portion, and side portions, the bottom portion joining the main and side portions to form a partially enclosed concave part into which a portion of said flexible enclosure is fitted and affixed, said external rigid support member fitting only over substantially a quadrant of said flexible enclosure so that the remaining substantially three quadrants of said flexible enclosure are not enclosed by a support member;

said flexible enclosure being formed of a strong material arranged as an enclosure having a top, sides and bottom portions, said sides being flexible so that when said bag does not contain contents said top can be collapsed into said concave part in a storage position;

said flexible enclosure including an opening formed in said enclosure and closure means connected to said enclosure so that said closure means can be engaged to close said opening*; and*

*said flexible enclosure includes a top, sides and a bottom portion, and said opening extends along one of said sides*.

7. A travel bag of claim [6] *1* wherein said opening extends the complete length of one of said sides.

10. A travel bag for enclosing, protecting and transporting contents placed therein comprising:

a flexible enclosure; and an external rigid support member, said flexible enclosure being formed of a strong material arranged as an enclosure having a top, sides and bottom portions, said flexible enclosure including an opening formed in said enclosure*, said opening extends along one of said sides,* and closure means connected to said enclosure so that said closure means can be engaged to close said opening;

said external rigid support member having a main portion, a bottom portion, and side portions, the bottom portion joining the main and side portions to form a partially enclosed cavity into which a portion of said flexible enclosure is fitted and affixed, the main portion extending from the bottom of said enclosure along a portion of the side and terminating near the middle of said enclosure, wherein said top can be collapsed into said partially enclosed cavity;

said external rigid support member fitting only over substantially a quadrant of said flexible enclosure so that the remaining substantially three quadrants of said flexible enclosure are not enclosed by a support member.

13. A travel bag of claim [12] *10* wherein said opening extends the complete length of one of said sides.

15. A travel bag for enclosing, protecting and transporting contents placed therein comprised of two primary members:

a flexible enclosure; and an external rigid support member, said flexible enclosure being formed of a strong material arranged as an enclosure having a top, sides and bottom portions, said flexible enclosure including an opening formed in said enclosure *which extends along one of said sides,* and closure means connected to said enclosure so that said closure means can be engaged to close said opening;

said external rigid support member being formed of a single piece rugged material having a main portion, a bottom portion, and side portions, the bottom portion joining the main and side portions to form a partially enclosed cavity into which a portion of said flexible enclosure is fitted and affixed, wherein said top can be collapsed into said partially enclosed cavity;

said external rigid support member fitting only over substantially a quadrant of said flexible enclosure so that the remaining substantially three quadrants of said flexible enclosure are not enclosed by a support member.

24. A travel bag of claim [23] *15* wherein said opening extends the complete length of one of said sides.

26. A travel bag for enclosing, protecting and transporting contents placed therein, said bag comprising two primary members as follows:

a flexible enclosure; and an external rigid support member, said flexible enclosure being formed of a strong material of a top, sides and bottom portions *with an opening extending along one of said sides*, said external rigid support member being formed of a single piece rugged material having a main portion, a bottom portion, and side portions, the bottom portion joining the main and side portions to form a partially enclosed cavity into which a portion of said flexible enclosure is fitted and affixed, wherein said top can be collapsed into said partially enclosed cavity;

said external rigid support member fitting only over substantially a quadrant of said flexible enclosure so that the remaining substantially three quadrants of said flexible enclosure are not enclosed by a support member.

34. A travel bag of claim [33] *26* wherein said opening extends the complete length of one of said sides.

* * * * *